US011122851B2

(12) United States Patent
Winger et al.

(10) Patent No.: US 11,122,851 B2
(45) Date of Patent: Sep. 21, 2021

(54) SHOES WITH SHAPE SHIFTING ORTHOTIC SOLES

(71) Applicant: The Winger Group, LLC, Monument, CO (US)

(72) Inventors: Albert P. Winger, Monument, CO (US); Robert B. Zajeski, Homer Glen, IL (US)

(73) Assignee: THE WINGER GROUP, LLC, Monument, CO (US)

( * ) Notice: Subject to any disclaimer, the term of this patent is extended or adjusted under 35 U.S.C. 154(b) by 137 days.

(21) Appl. No.: 15/850,515

(22) Filed: Dec. 21, 2017

(65) Prior Publication Data

US 2018/0184750 A1 Jul. 5, 2018

Related U.S. Application Data

(60) Provisional application No. 62/441,781, filed on Jan. 3, 2017.

(51) Int. Cl.

| | |
|---|---|
| ***A43B 3/00*** | (2006.01) |
| ***A43B 13/12*** | (2006.01) |
| ***A43B 13/18*** | (2006.01) |
| ***A43B 17/02*** | (2006.01) |
| ***A43B 17/03*** | (2006.01) |

(Continued)

(52) U.S. Cl.

CPC ..... *A43B 3/0005* (2013.01); *A43B 13/12* (2013.01); *A43B 13/188* (2013.01); *A43B 17/006* (2013.01); *A43B 17/026* (2013.01); *A43B 17/035* (2013.01); *A43B 3/246* (2013.01); *A43B 7/1415* (2013.01)

(58) Field of Classification Search

CPC ..... A43B 3/0005; A43B 3/246; A43B 13/12; A43B 13/188; A43B 17/006; A43B 17/026; A43B 17/035; A43B 7/1415; A43B 5/00; A43B 13/00; A43C 13/00

USPC ..... 3/113; 36/113

See application file for complete search history.

(56) References Cited

U.S. PATENT DOCUMENTS 5,179,792 A * 1/1993 Brantingham ..... A43B 3/0005 251/4

5,813,142 A * 9/1998 Demon ..... A43B 3/0005 36/28

(Continued)

OTHER PUBLICATIONS

Web page, https://www.indiegogo.com/projects/hi-tech-heels-flats-feel-like-sneakers-inside-design-technology#/, dated 2017, 23 pages.

(Continued)

*Primary Examiner* — Khoa D Huynh

*Assistant Examiner* — Uyen T Nguyen

(74) *Attorney, Agent, or Firm* — Ryan Kromholz & Manion, S.C.

(57) ABSTRACT

A shape shifting orthotic sole having a cushioning layer, shape changing layer, and a sensing layer in communication, the shape changing layer and sensing layer communicatively coupled with a power source and circuitry unit which provides for default and evolving settings, and automatic and manual support settings for the shape changing region as a result of input from the sensing layer. The shape shifting orthotic sole may communicate with a cellular device and other device able to maintain mobile applications, and an IOT Health Monitoring Device during the operation of the shape shifting orthotic sole.

16 Claims, 8 Drawing Sheets

(51) Int. Cl.

| | |
|---|---|
| ***A43B 17/00*** | (2006.01) |
| ***A43B 7/14*** | (2006.01) |
| ***A43B 3/24*** | (2006.01) |

(56) References Cited

U.S. PATENT DOCUMENTS

| | | | | |
|---|---|---|---|---|
| 6,430,843 | B1 * | 8/2002 | Potter | A43B 3/0005 36/28 |
| 8,058,837 | B2 | 11/2011 | Beers et al. | |
| 8,525,386 | B2 * | 9/2013 | Pas | A61B 5/1036 310/314 |
| 9,060,564 | B2 * | 6/2015 | Langvin | A43B 7/144 |
| 10,264,850 | B2 * | 4/2019 | Lam | A43B 13/186 |
| 2003/0067245 | A1 * | 4/2003 | Pelrine | H01L 41/042 310/311 |
| 2004/0154190 | A1 * | 8/2004 | Munster | A43B 13/12 36/28 |
| 2005/0268487 | A1 * | 12/2005 | Ellis, III | A43B 13/14 36/25 R |
| 2006/0288612 | A1 * | 12/2006 | Lucas | A43B 13/186 36/28 |
| 2007/0000154 | A1 * | 1/2007 | DiBenedetto | A43B 13/181 36/132 |
| 2013/0291399 | A1 * | 11/2013 | Fonte | A43B 7/141 36/44 |
| 2016/0262485 | A1 * | 9/2016 | Walker | A43C 11/165 |
| 2016/0299021 | A1 * | 10/2016 | Thillainadarajah | G01L 5/16 |
| 2016/0344309 | A1 * | 11/2016 | Otagiri | F03G 5/06 |
| 2016/0345663 | A1 * | 12/2016 | Walker | A43B 3/0005 |
| 2016/0345669 | A1 * | 12/2016 | Orand | A43B 13/189 |
| 2016/0361230 | A1 * | 12/2016 | Zahrieh | A43B 7/085 |
| 2017/0188950 | A1 * | 7/2017 | Gazdag | A43B 3/0005 |
| 2017/0273599 | A1 * | 9/2017 | Reese | G01L 1/146 |
| 2018/0132566 | A1 * | 5/2018 | Rosenblatt | A43B 17/026 |
| 2018/0295932 | A1 * | 10/2018 | Wong | A43B 13/181 |
| 2019/0289951 | A1 * | 9/2019 | Jo | G01L 9/06 |

OTHER PUBLICATIONS

Web page, https://9to5toys.com/2017/03/24/under-armour-futurist/, dated Mar. 24, 2017, 3 pages.
Web video, https://www.youtube.com/watch?v=FGQ_7fMXBf8, dated Aug. 21, 2013, 2 pages.
Web page, https://www.livescience.com/49462-energy-harvesting-shoe-device.html, dated Jan. 14, 2015, 3 pages.
Web page, https://en.wikipedia.org.wiki/Shape-memory_polymer, dated Dec. 3, 2017, 5 pages.

* cited by examiner

SHOES WITH SHAPE SHIFTING ORTHOTIC SOLES

RELATED APPLICATION

This application claims the benefit of U.S. Provisional Patent Application Ser. No. 62/441,781, filed 3 Jan. 2017.

BACKGROUND OF THE INVENTION

The inventors have come to realize from their own experience while generally walking and exercising that sore feet issues are very common problems for people all over the world. The condition of sore feet causes activities such as standing, walking, running, dancing or working, to become burdensome if not extremely difficult.

The foot is a complex structure of twenty-six bones and thirty-three joints, layered with an intertwining web of more than 120 muscles, ligaments and nerves. Due to the relative small size of the foot as compared to the rest of the body, impact from a step exerts tremendous force upon the foot. The force on the foot of an individual, during a step, can be 50% greater than the individual's body weight. Moreover, during a typical day, individuals spend approximately four hours on their feet and take 8,000 to 10,000 steps. Thus, on average an individual's feet support a combined force equivalent to several hundred tons each day. Extrapolating the combined force overtime yields an enormous sum considering most individuals in the United States travel 75,000 miles on their feet by the age of 50.

The foot serves several functions: supporting weight; absorbing shock; acting as a lever propelling the leg forward; and assisting the body in maintaining balance by adjusting to varied surface orientations.

Individuals often do not focus on foot comfort during commonplace activities. However, such inattentiveness to feet changes once an individual's feet become sore. In fact, approximately 75% of individuals in the United States of America experience some variation of foot pain. Women are at a higher risk for foot pain as compared to men.

The question arises, what caused the pain at issue. Causes for sore feet, or pain in feet, range from user activity to inherent physiological conditions.

User activities causing sore feet include: foot trauma; overuse; sports injury; high Impact activities; improper footwear; ill-fitting footwear; high-heels; and recently acquired pair of shoes. Examples of resulting conditions which cause sore feet include: ligament strain; broken toe; Achilles tendinitis; avulsion fracture; plantar fasciitis; retro calcaneal bursitis; septic arthritis; tarsal tunnel syndrome (both a symptom of user activity and an inherent physiological condition); and tendinitis.

Inherent physiological conditions causing sore feet include: age of the individual; weight of the individual; pregnancy; muscle strain; high arches; and flat feet; bone spurs; bunions; bursitis; corns; calluses; diabetic neuropathy; Gout; Haglund's deformity; hammer toe and mallet toe; ingrown toe nails; metatarsalgia; osteoarthritis; peripheral neuropathy; plantar warts; psoriatic arthritis; reactive arthritis; rheumatoid arthritis; and excessive pronation.

Pursuant to the American Podiatric Medical Association, the most common types of shoe inserts include: arch supports; insoles; heel liners; and foot cushions. Insoles are made of gel, foam, or plastic. The use of polymers is well known for decades and has been used in shoe manufacturing and in the manufacturing of shoe inserts. The vast majority provide comfort through working as cushioning pads or sols which conform to the foot. For severe foot conditions causing imbalance, health care providers may prescribe custom orthotics which are insoles produced to fit the patient's foot. Such insoles may be static molds, a memory foam substrate or thermally molding (either electronically or conducting heat from the user's body).

However, the previously mentioned inserts have passive and inadequate foot support which fail to transition and adjust support according each movement and placement of the shoe. Shoes with shape shifting orthotic soles feel movement and will adjust to cradle the foot bed with each and every movement to provide more comfortable and supported feet. Therefore, there exists a need for a shape shifting orthotic and sole which is adapted to actively adjust to the external environment.

SUMMARY OF THE INVENTION

The present invention is directed to a shoe with containing a built-in shape shifting orthotic soles in each shoe unit. The shape shifting sole is molded to provide a more supportive and more comfortable shoe construction. The shape shifting orthotic sole will provide constant feedback and will be connected to a mobile device application for the recording of data. In an alternative embodiment the shaping shifting sole is a shoe insert removable from the shoe.

A shape shifting orthotic sole for footwear comprising: an at least one shape changing layer having a first side and a reverse side; the at least one shape changing layer having an at least one shape changing polymer region; the at least one shape changing polymer region providing for an at least one support setting; the reverse side of the at least one shape changing layer in communication with a first side of an at least one sensing layer; the at least one sensing layer having an at least one region, where the at least one region is a sensing region; a power source and circuitry unit in substantial proximity with at least one of the at least one shape changing layer and the at least one sensing layer; the power source and circuitry unit communicatively coupled with the at least one region of the at least one sensing layer, wherein the power source and circuitry unit receives an at least one pressure measurement from the at least one region of the at least one sensing layer at a predetermined time interval; the power source and circuitry unit communicatively coupled with the at least one shape changing polymer region of the at least one shape changing layer, the power source and circuitry unit including an automatic adjustment of an at least one calculated support setting, wherein the power source and circuitry unit communicates the at least one calculated support setting to the at least one shape changing polymer region provided through calculations employing the at least one pressure measurement from the at least one region of the at least one sensing layer received at the predetermined time interval.

The shape shifting orthotic sole for footwear further comprising a cushioning layer providing for a first side for placement of a foot and reverse side, with the reverse side of the cushioning layer in communication with the first side of the at least one shape changing layer, with the cushioning layer comprising a shell and a core, with the power source and circuitry unit in substantial proximity to the cushioning layer.

The shape shifting orthotic sole for footwear further comprising the shape shifting orthotic sole in at least one of a fixed communication with an interior floor of a shoe, defined by a back, a front, an exterior sole and the interior floor, and a removable communication with the interior floor of the shoe, wherein a user places a foot into the shoe and rests the foot on the shape shifting orthotic sole.

The shape shifting orthotic sole for footwear further comprising a shape of the shape shifting orthotic sole received by at least one of the interior floor, a lateral wall, an anterior wall and a posterior wall of the shoe, with the shape providing for mechanical adjustment.

The shape shifting orthotic sole for footwear further comprising the power source and circuitry unit in communication with at least one predetermined location on the shoe.

The shape shifting orthotic sole for footwear further comprising the at least one shape changing layer having a plurality of shape changing polymer regions.

The shape shifting orthotic sole for footwear further comprising the sensing layer is a graphene sensing layer.

The shape shifting orthotic sole for footwear further comprising the power source and circuitry unit communicatively coupled with the at least one sensing layer through at least one of a solid wiring and a USB system.

The shape shifting orthotic sole for footwear further comprising the at least one shape changing polymer region of the at least one shape changing layer having three support settings; rigid, semi-rigid, soft.

The shape shifting orthotic sole for footwear further comprising the at least one shape changing layer providing for at least one of a shape memory pneumatic layer containing a closed pneumatic system, and the shape memory pneumatic layer containing a closed hydraulic system.

The shape shifting orthotic sole for footwear further comprising the power source and circuitry unit including a piezoelectric system, wherein the power source and circuitry unit recharges through a motion of a user.

The shape shifting orthotic sole for footwear further comprising the power source and circuitry unit including at least one of a default setting and an evolving setting.

The shape shifting orthotic sole for footwear further comprising the power source and circuitry unit electrically coupled with the at least one shape changing polymer region of the at least one shape changing layer, the power source and circuitry unit including a manual adjustment for the at least one calculated support setting, wherein the power source and circuitry unit communicates the at least one calculated support setting to the at least one shape changing polymer region through a manual input of the at least one calculated support setting.

The shape shifting orthotic sole for footwear further comprising the shape shifting orthotic sole including for a calibration.

The shape shifting orthotic sole for footwear further comprising the power source and circuity unit including a sensing and adjustment circuitry and a transceiver circuitry, with the sensing and adjustment circuitry communicatively coupled with the transceiver circuitry.

The shape shifting orthotic sole for footwear further comprising the sensing and adjustment circuitry communicatively coupled with the at least one region of the at least one sensing layer, the sensing and adjustment circuitry communicatively coupled with the at least one shape changing polymer region of the at least one shape changing layer with the sensing and adjustment circuitry including at least one of the automatic adjustment and the manual adjustment, the sensing and adjustment circuitry including at least one of the default setting and the evolving setting, wherein the sensing and adjustment circuitry receives an at least one pressure measurement from the at least one region of the at least one sensing layer at the predetermined time interval and the sensing and adjustment circuitry communicates an at least one calculated support setting to the at least one shape changing polymer region.

The shape shifting orthotic sole for footwear further comprising the sensing and adjustment circuitry communicatively coupled with the transceiver circuitry, the sensing and adjustment circuitry including at least one first reception from the transceiver circuitry, an at least one first transmission to the transceiver, and an at least one second reception from the transceiver, wherein the at least one first reception is a calibration request, the at least one first transmission is the at least one pressure measurement, and the at least one second reception is the at least one calculated support setting.

The shape shifting orthotic sole for footwear further comprising the transceiver communicatively coupled with at least one of a cellular device and a other device able to maintain mobile applications, the at least one of the cellular device and the other device able to maintain mobile applications including at least one second transmission to the transceiver, an at least one third reception from the transceiver, and at least one third transmission to the transceiver, wherein the at least one second transmission is a calibration request, the at least one third reception is a receipt of the at least one pressure measurement, and the at least one third transmission is a transmission of the at least one calculated support setting.

The shape shifting orthotic sole for footwear further comprising an IOT Health Monitoring Device communicatively coupled with the transceiver, the transceiver including an at least one fourth reception from the IOT Health Monitoring Device and an at least one fourth transmission to the at least one of the cellular device and the other device able to maintain mobile applications, wherein the at least one fourth reception and the at least one transmission concern transmitting of data from the IOT Health Monitoring Device for use in calculating of the at least one calculated support setting.

The shoe may be designed for running, walking, jogging, orthopedic care, pediatric care, geriatric care, cross-training, cycling in various formats, and various athletic sports (including football, basketball, soccer, baseball, rugby, track and field, volleyball, lacrosse, cross-country racing, tennis, and racquetball). Alternatively, the shoe device may be a sandal or similar foot wearing article. The shoe contains the back, the front, and the exterior sole. The exterior sole having a spectrum of the sole.

The shoe may preferably incorporate the shape shifting orthotic sole. The shape shifting orthotic sole may reside on the interior floor of the shoe. The shape shifting orthotic may occupy a foot placement surface in communication with the interior floor of the shoe. Alternatively the shape shifting orthotic sole may extend beyond the foot placement surface and along the lateral, the anterior and/or the posterior interior walls of the shoe. The shape shifting orthotic may be chemically or mechanically attached to the interior floor of the shoe, the lateral interior wall of the shoe, the anterior interior wall of the shoe, and/or the posterior interior wall of the shoe. A user may place the foot into the shoe, and rest the foot onto the shape shifting orthotic sole located as the foot placement surface within the interior of the shoe.

The shape of the shape shifting orthotic sole preferably may occupy a shape of the interior floor of the shoe. Alternatively, the shape of the shape shifting orthotic sole may incorporate the lateral, the anterior and/or the posterior interior walls of various shoe designs. Alternatively, the shape of the shape shifting orthotic may provide for a mechanical adjustment of the shape of the shape shifting orthotic sole to accommodate various shapes of interior floor of the shoe. The shape of a singular shape shifting orthotic sole varies in dimensions along a length of the foot (x-axis) and along a width of the foot (y-axis). The shape shifting orthotic sole may vary continuously in a depth (z-axis), perpendicular to the x-axis and y-axis, along the x-axis and y-axis. The shape shifting orthotic may be represented in a variety of shoe sizes covering a span between and including small children (3 years old) to adults.

The shape shifting orthotic sole may preferably incorporate three individual layers and the power source and circuitry unit, the power source and circuitry unit comprising the sensing and adjustment circuitry and the transceiver circuitry in chemical or mechanical communication with one another. Alternatively the shape shifting orthotic sole may include as little as one or a plurality greater than three layers. A first layer of the shape shifting orthotic sole is in direct contact with the user's foot. The first layer comprises the top side, the reverse side, and a lateral side. Preferably the top side of the first layer comprises the foot placement surface. The first layer may preferably be the cushioning layer. The first layer may incorporate the shell made of a fiber, a mesh, a paper based, or a cloth matrix, or a combination thereof. The core of the first layer may comprise a fiber, a mesh, a paper based, a cloth matrix, or a vacant cavity interior. The lateral side of the first layer may be a uniform depth (z-axis) perpendicular to the x-axis and the y-axis. Alternatively, the depth (z-axis) of said first layer may vary along both the x-axis and y-axis segmentally and/or continuously.

The reverse side of the first layer is chemically or mechanically adhered to a top side of a second layer. The second layer comprises the top side, a reverse side and a lateral side. The second layer is preferably the shape changing polymer layer. The shape changing polymer layer may be composed of a singular variation of polymer or multiple variations of polymers. The second layer is preferably segmented into four shape changing regions: a front toe section (Region 1); a second section located at a ball region of said foot or shoe (Region 2); a third mid-section located at an arch of said foot or shoe (Region 3); and a fourth posterior section in communication with the back of said foot or shoe (Region 4). In the alternative, the second layer is composed of from one to an indeterminate plurality of shape changing regions.

The partitions between each region may preferably be continuous lines parallel to the y-axis with non-varying orientation separating the shape shifting orthotic sole regions. Alternatively, the partitions may be continuous lines parallel in direction to the y-axis with varying orientation separating the shape shifting orthotic sole regions, or discontinuous lines parallel in direction to the y-axis with varying orientation and/or non-varying orientation separating the shape shifting orthotic sole regions. Alternatively, the partitions between each region may be parallel to the x-axis. Alternatively, the partitions for shape changing regions may be symmetrical geometric structures, or non-symmetrical geometric structures.

The second layer may be a uniform depth (z-axis) perpendicular to the x-axis and the y-axis. Alternatively, the depth (z-axis) of the second layer may vary along both the x-axis and the y-axis segmentally and/or continuously.

The reverse side of the second layer may be electrically connected to a top side of a third layer. In addition, the reverse side of the second layer is chemically or mechanically adhered to the top side of the third layer. The third layer is preferably the graphene sensing layer, and is divided into the multiple sensing regions. The third layer comprises the top side, a reverse side, and a lateral side. The third layer may be a uniform depth (z-axis) perpendicular to the x-axis and the y-axis. Alternatively, the depth (z-axis) of the cushioning layer may vary along both the x-axis and the y-axis segmentally and/or continuously.

The reverse side of the third layer is preferably chemically or mechanically adhered to a top side of the power source and circuitry unit. In addition, the power source and circuitry unit is electrically connected to the third layer. An electrical connection between the power and circuitry unit and the third layer is preferably the solid wiring connected between the layers or direct contact between the layers. Alternatively, the electrical connection between the power source and circuitry unit the said third layer may be through the use of the USB-A, USB-B, USB-mini, or USB-micro cable system. The electrical connection location on the third layer is preferably on the reverse side of the third layer. Alternatively, the connection point of the third layer may be located on the lateral side of the third layer.

The power source and circuitry unit may preferably be located towards a posterior or heel direction of the shape shifting orthotic sole. The power source and circuitry unit may be a uniform depth (z-axis) perpendicular to the x-axis and y-axis. Alternatively, the depth (z-axis) of the power source and circuitry unit may vary along both the x-axis and y-axis segmentally and/or continuously. Alternatively, the power source and circuitry unit may be communicated to the back of the shoe. The power source and circuitry unit preferably rests on the foot placement surface of the shoe. Alternatively, the power source and circuitry unit is recessed into a sole portion of the shoe. The power source and circuitry unit may rest at a depth along a spectrum of the sole portion of the shoe. The power source and circuitry unit may alternatively be adhered chemically or mechanically to the back of the shoe.

The regions of the second layer preferably nave three support settings. A user exerts force on the shape shifting orthotic sole. The shape shifting orthotic sole may preferably respond with one or a combination of the following support settings:

Rigid: Used to reduce pronation, increase stability when forces are significant.

Semi-Rigid: Used to provide balance during motion when forces are moderate.

Soft: Used to absorb shocks and improve balance, reduce pressure when forces are minor.

Alternatively, the regions can have a support setting spectrum which is continuous and not segmented.

The, graphene, third layer may be electrically connected to the sensing and adjustment circuitry within the power source and circuitry unit. One of the most useful properties of graphene is that it is a zero-overlap semimetal (with both holes and electrons as charge carriers) with very high electrical conductivity. The electrical connection may be sourced from an amalgamation of connecting wires which are sourced from various regions of the third layer. Alternatively, the electrical connection may be segmented by region of the third layer. The sensing and adjustment circuitry within the power source and circuitry unit may be electrically connected to the regions within the second layer. A connection to the sensing and adjustment circuitry within the power source and circuitry unit may be an amalgamation of connecting wires sourced from the second layer. Alternatively, the electrical connection between the sensing and adjustment circuitry within the power source and circuitry unit and the shape memory polymer layer maybe individual connections. A terminal end of the electronic connection to the second layer maybe be a singular point, divided into a series of conduits with terminal ends, or a metallic mass of varying orientations (circular disc, circular ring, polygon disc, polygon frame, etc.).

The sensing and adjustment circuitry within the power source and circuitry unit is additionally electrically connected to the transceiver circuitry within the power source and circuitry unit. The transceiver circuitry communicates with a cellar device or other device having the ability to house and maintain mobile applications. Alternatively, the IOT Health Monitoring Device maybe incorporated. The IOT Health Monitoring Device communicates vital statistics of the user to the transceiver circuitry. The transceiver circuitry communicates to the cellar device, or other device having the ability to house and maintain mobile applications, data which includes user vital statistics communicated to the transceiver circuitry from the IOT Health Monitoring Device.

In an alternative embodiment, the sensing and adjustment circuitry and the transceiver circuitry may be located at different locations of the shoe, where only one or none is located in the power source and circuitry unit. In such an embodiment, the sensing and adjustment circuitry is additionally electrically connected to the transceiver circuitry. In such an embodiment, at least one of the sensing and adjustment circuitry and the transceiver circuitry may be in mechanical or in chemical communication with at least one of the first layer, the second layer, the third layer, and the shoe, at an at least one of an indefinite number of locations along at least one of the first layer, the second layer, the third layer, and the shoe.

In an alternative embodiment, the second layer incorporates the shape memory pneumatic layer. The shape memory pneumatic layer may be composed of the shape shifting memory foam. Encase within the shape shifting memory foam may be the closed pneumatic system. The closed pneumatic system may contain regions for air accumulation connected to one another by a series of passage ways. The number and orientation of the regions of air accumulation may vary dependent on the application of the shoe and dimensional restrictions of the shoe. The system of passage ways may contain individual passage ways which vary in length dependent on the distance between regions of air accumulation. The number of passage ways between any two regions of air accumulation may vary in number. Situated along the system of passages may be pneumatic valve devices. The pneumatic valve devices are preferably located between regions for air accumulation. The pneumatic valve devices may bi-sect the air passageway or at any location along the air passageway. Alternatively, the pneumatic valve devices may be situated within a region for air accumulation. Additionally, multiple pneumatic valve devices may be located in any or all regions for air accumulation. The closed pneumatic system may contain a singular or a plurality of regions of air accumulation, passage ways, and/or pneumatic valve devices.

The regions for air accumulation and the system of passage ways preferably are encased within the shape shifting polymer layer. Alternatively, the regions of air accumulation and/or the system of passage ways may penetrate the top side or reverse side of the second layer, and/or penetrate the lateral side of the second layer. Alternatively the closed pneumatic system may be the closed hydraulic system. The closed hydraulic system may contain a water based fluid. Alternatively, the closed hydraulic system may contain a fluid which resists freezing. In this embodiment the pneumatic valve devices may be substituted for hydraulic valve devices. In this embodiment the regions of air accumulation may be replaced by regions of hydraulic accumulation. The closed hydraulic system may contain a singular or a plurality of regions of hydraulic accumulation, passage ways, and/or hydraulic valve devices. The pneumatic valve devices of the closed pneumatic system and the hydraulic valve devices of the closed hydraulic system may operate to transfer fluids (air of hydraulic) to the appropriate regions of air accumulation or regions of hydraulic accumulation in order to attain desired pressure settings in the shape shifting orthotic sole.

A power source within the power source and circuitry unit may be recharged with the piezoelectric system. Where the motion of the user recharges the power source. Alternatively, the power source within the power source and circuitry unit may be recharged with an inductive coil system. The inductive coil system contains inductive coils in the shoe power source and circuitry unit, and in an external power recharging source. Contact between the shoe containing the power source and the external power recharging source results in a transfer of energy to the power source within the shoe. Alternatively, the power source may be recharged with a magnetic field based system.

In an alternative embodiment, the shape shifting orthotic may be incorporated in a shoe insert. The shape shifting layers of the shoe insert are composed and comprised similar to that of the shape shifting orthotic sole.

A method of use is further provided wherein a user places a foot down on the top side of the first layer. The user may stand in an ergonomic position 910. The user may upload a mobile application and starts using the mobile application using a cellar device or other device having the ability to house and maintain mobile applications. The user may calibrate settings for the shape shifting orthotic sole. The mobile application may transmit a request, via the cellar device or other device having the ability to house and maintain mobile applications, for the calibration to the power source and circuitry unit. The power source and circuitry unit may commence the calibration. The calibration may measure and may log the pressure readings from the regions on the third layer. The third layer may transmit information, via the sensing and adjusting circuitry, to the transceiver circuitry. The transceiver circuitry may transmit information to the cellular device or other device having the ability to house and maintain mobile applications. The mobile application may record baseline and differential pressures during walking or running. The mobile application may record vital statistics from an IOT Health Monitoring Device.

The user may proceed to designate the settings for the shape shifting memory sole or shape shifting memory sole insert. The user may choose between the default settings, all regions in the second layer are provided equivalent support, and the evolving settings, each region in the second layer is provided individualized settings. The user may begin an activity, whether it be sitting, standing, walking, running, jumping, etc.

Layer three of the shape shifting memory sole or shape shifting memory sole insert may transmit pressure signals to the sensing and adjustment circuitry, which may communicate to the cellular device or other device having the ability to house and maintain mobile applications via transceiver circuitry. Alternatively, an IOT Health Monitoring Device communicates vital statistics of the user to the transceiver circuitry. The transceiver circuitry communicates the pressure signals and user vital statistics to the cellular device or other device having the ability to house and maintain mobile applications.

The mobile application may perform calculations based on the user's earlier input. Alternatively, the mobile application incorporates the user vital statistics into the calculations with the user's earlier inputs. Where the user requested default settings, the mobile application may calculate median pressure for all regions. Where the user requested evolving settings, the mobile application may calculate pressure for each region.

The user may initially designate whether the system will automatically adjust pressure settings or whether the user will manually adjust pressure settings. Where the user chooses to have the system automatically adjust pressure settings, the mobile application may determine appropriate pressure settings for default and evolving settings. Where the user chooses to manually adjust pressure settings, the user may input the desired pressure settings.

The mobile application may send a signal via the cellular device or other device having the ability to house and maintain mobile applications to the transceiver circuitry which may be in communication with the sensing and adjusting circuitry. The signal may be transferred to the second layer. In the case of default settings, a uniform signal may be transferred to each region of the second layer. The regions of the second layer may adjust in uniform. In the case of evolving settings, individualized signals may be sent to individual regions of the second layer. The individual regions of the second layer may adjust according to the pressure settings received.

Where the user has chosen the automatic adjustment, the measuring and adjustment process may continue automatically at a set time interval. Where the user has chosen the manual adjustment feature, the measuring process may continue at a set time interval. However, pressure settings may not be adjusted unless the user provides new input.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention.

Figure 1:
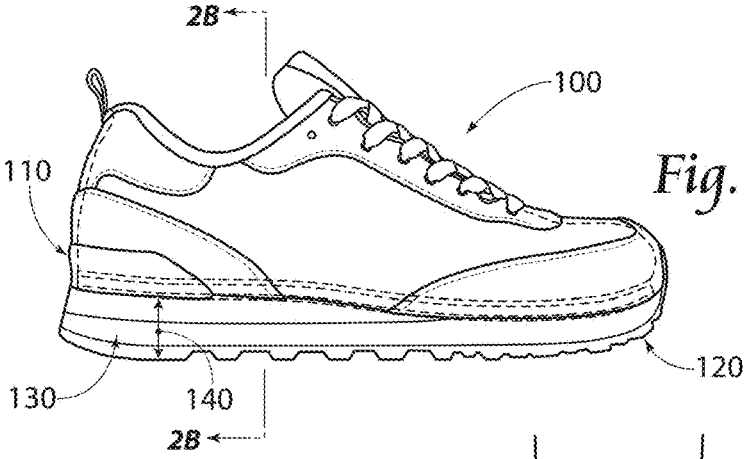
FIG. 1 is a side view of the shoe embodiment of the invention.
Figure 2A:
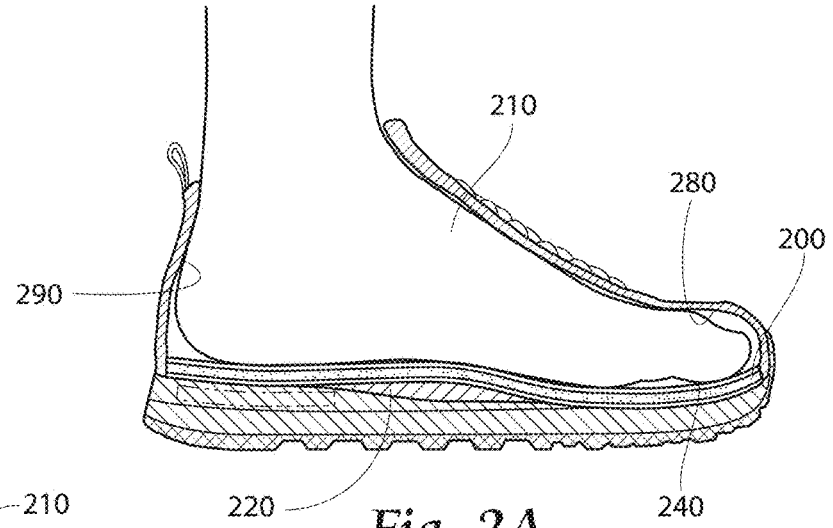
FIG. 2A is a cross-sectional side view, as shown from FIG. 2B, of the shoe embodiment of the invention in which the shape shifting orthotic sole is illustrated.

With attention directed to FIGS. 1 and 2A, the present invention is directed to a shoe 100 with containing a built-in shape shifting orthotic soles 200 in each shoe unit. The shoe may be designed for running, walking, jogging, orthopedic care, pediatric care, geriatric care, cross-training, cycling in various formats, and various athletic sports (including football, basketball, soccer, baseball, rugby, track and field, volleyball, lacrosse, cross-country racing, tennis, and racquetball). Alternatively, the shoe 100 may be a sandal or similar foot wearing article. The shoe 100 contains a back 110, a front 120, and an exterior sole 130. The exterior sole 130 having a spectrum of the sole 140.

Figure 2B:
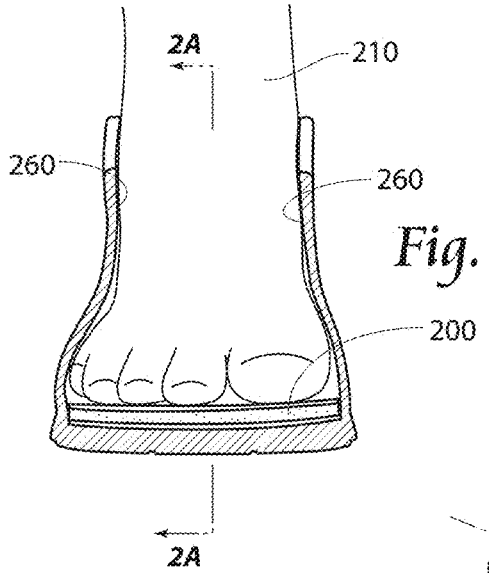
FIG. 2B is a cross-sectional anterior view, as shown from FIG. 1, of the shoe embodiment of the invention in which the shape shifting orthotic is illustrated.

As shown in, FIGS. 2A and 2B, the shoe 100 may preferably incorporate the shape shifting orthotic sole 200. The shape shifting orthotic sole 200 may reside on an interior floor 220 of the shoe 100. The shape shifting orthotic sole 200 may occupy a foot placement surface 240 in communication with the interior floor 220 of the shoe 100. Alternatively the shape shifting orthotic sole 200 may extend beyond the foot placement surface 240 and along a lateral 260, an anterior 280 and/or a posterior 290 interior walls of the shoe 100. The shape shifting orthotic sole 200 may be chemically or mechanically attached to the interior floor 220 of the shoe 100, the lateral 260 interior wall of the shoe, the anterior 280 interior wall of the shoe, and/or the posterior 290 interior wall of the shoe. A user may place a foot 210 into the shoe 100, and rest the foot 210 onto the shape shifting orthotic sole 200 located as the foot placement surface 240 within the interior of the shoe 100.

Figure 3:
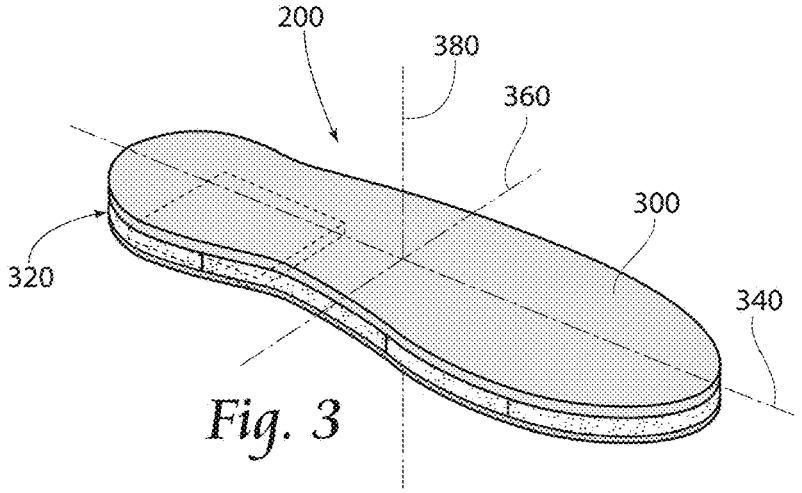
FIG. 3 is a perspective view of the shape shifting orthotic sole.

As viewed particularly in FIG. 3, the shape 300 of the shape shifting orthotic sole 200 preferably may occupy a shape 300 of the interior floor 220 of the shoe 100. Alternatively, the shape 300 of the shape shifting orthotic sole 200 may incorporate the lateral 260, the anterior 280 and/or the posterior 290 interior walls of various shoe designs. Alternatively, the shape of the shape shifting orthotic may provide for a mechanical adjustment of the shape of the shape shifting orthotic sole to accommodate various shapes of interior floor of the shoe. The shape 300 of a singular shape shifting orthotic sole 200 varies in dimensions along a length of the foot (x-axis) 340 and along a width of the foot (y-axis) 360. The shape shifting orthotic sole may vary continuously in a depth (z-axis) 380, perpendicular to the x-axis 340 and y-axis 360, while traversing along the x-axis 340 and y-axis 360. The shape shifting orthotic sole 200 may be represented in a variety of shoe sizes covering a span between and including small children (3 years old) to adults.

Figure 4:
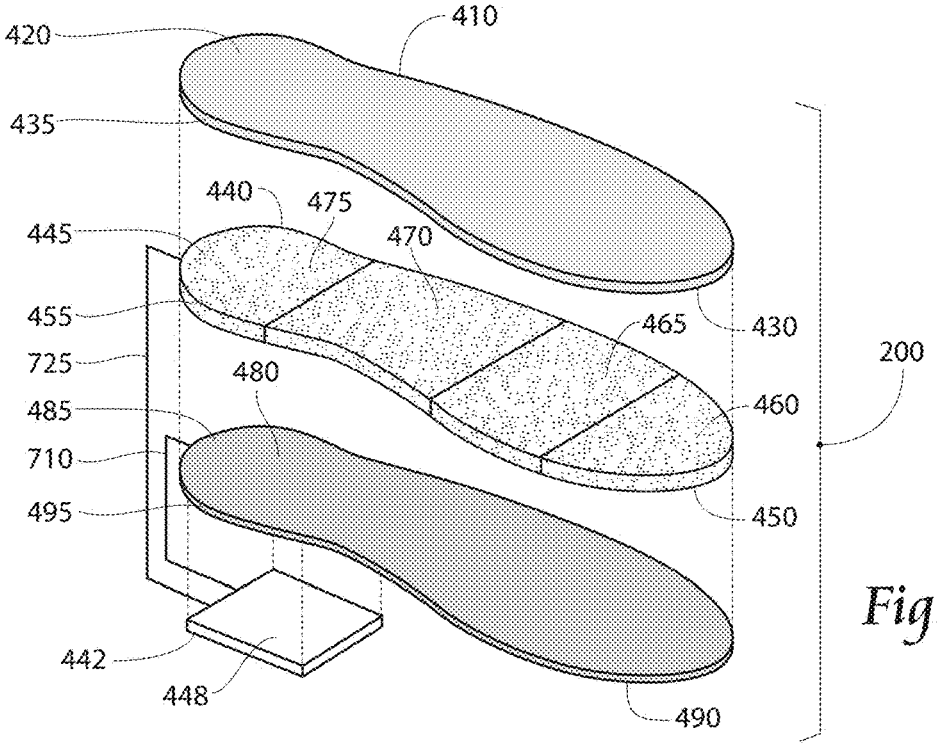
FIG. 4 is an exploded perspective of the shape shifting orthotic sole which contains the first layer, the second layer, the third layer, and a power source and circuitry unit.

FIG. 4 illustrates, the shape shifting orthotic sole 200 may preferably incorporate three individual layers in chemical or mechanical communication with one another. Alternatively the shape shifting orthotic sole 200 may include as little as one or a plurality greater than three layers. A first layer 410 of the shape shifting orthotic sole 200 is in direct contact with the user's foot 210. The first layer 410 comprises a top side 420, a reverse side 430, and a lateral side 435. Preferably the top side of the first layer comprises the foot placement surface 240. The first layer 410 may preferably be a cushioning layer. The first layer 410 may incorporate a shell made of a fiber, a mesh, a paper based, or a cloth matrix, or a combination thereof. A core of the first layer 410 may comprise a fiber, a mesh, a paper based, a cloth matrix, or a vacant cavity interior. The lateral side 435 of the first layer 410 may be a uniform depth (z-axis) 380 perpendicular to the x-axis 340 and the y-axis 360. Alternatively, the depth (z-axis) 380 of said first layer may vary along both the x-axis 340 and y-axis 360 segmentally and/or continuously.

The reverse side 430 of the first layer 410 is chemically or mechanically adhered to a top side 445 of a second layer 440. The second layer 440 comprises the top side 445, a reverse side 450 and a lateral side 455. The second layer 440 is preferably a shape changing polymer layer. The second layer 440 may be composed of a singular variation of polymer or multiple variations of polymers. The second layer 440 is preferably segmented into four shape changing regions: a front toe section (Region 1) 460; a second section located at a ball region of the foot or shoe 100 (Region 2) 465; a third mid-section located at an arch of the foot or shoe 100 (Region 3) 470; and a fourth posterior section in communication with the back 110 of foot or shoe 100 (Region 4) 475. In the alternative, the second layer 440 is composed of from one to an indeterminate plurality of shape changing regions (460, 465, 470, and 475).

Figure 5A:
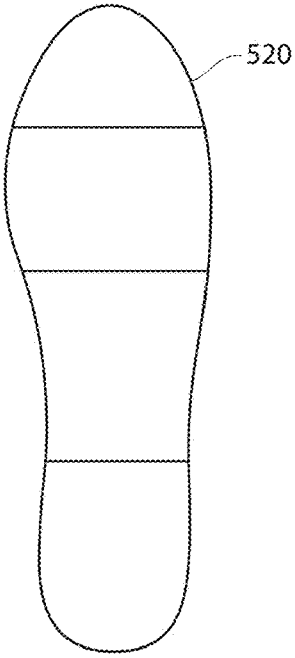
FIG. 5A is a top side view of the second layer illustrating continuous lines parallel to the y-axis with non-varying orientation separating the shape shifting orthotic sole regions.
Figure 5B:
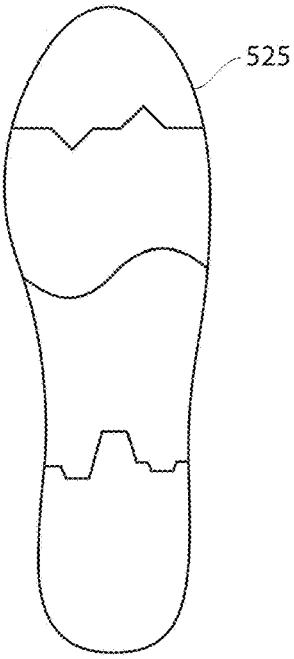
FIG. 5B is a top side view of the second layer illustrating continuous line parallel in direction to the y-axis with varying orientation separating the shape shifting orthotic sole regions.
Figure 5C:
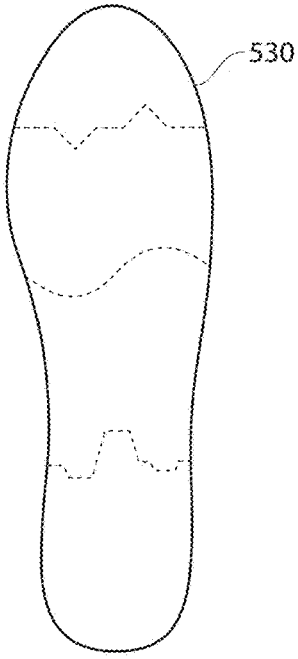
FIG. 5C is a top side view of the second layer illustrating discontinuous line parallel in direction to the y-axis with varying orientation and/or non-varying orientation separating the shape shifting orthotic sole regions.

As identified further in FIGS. 5A, 5B, and 5C, partitions (520, 525, 530) between each region (460, 465, 470, and 475) in the second layer 440 may preferably be continuous lines parallel to the y-axis 360 with non-varying orientation 520 separating the shape shifting orthotic sole 200 regions (460, 465, 470, and 475). Alternatively, the partitions (520, 525, 530) may be continuous lines parallel in direction to the y-axis 360 with varying orientation 525 separating the shape shifting orthotic sole 200 regions (460, 465, 470, and 475), or discontinuous lines parallel in direction to the y-axis 360 with varying orientation and/or non-varying orientation separating the shape shifting orthotic sole 200 regions (460, 465, 470, and 475). Alternatively, the partitions (520, 525, 530) between the regions may be parallel to the x-axis 340. Alternatively, the partitions (520, 525, 530) for regions may be symmetrical geometric structures, or non-symmetrical geometric structures.

The second layer 440 may be a uniform depth (z-axis) 380 perpendicular to the x-axis 340 and the y-axis 360. Alternatively, the depth (z-axis) 380 of the second layer may vary along both the x-axis 340 and the y-axis 360 segmentally and/or continuously.

The reverse side 450 of the second layer 440 may be electrically connected to a top side 485 of a third layer 480. In addition, the reverse side 450 of the second layer 440 is chemically or mechanically adhered to the top side 485 of the third layer 480. The third layer 480 is preferably a graphene sensing layer, and is divided into multiple sensing regions. The third layer 480 comprises the top side 485, a reverse side 490, and a lateral side 495. The third layer 480 may be a uniform depth (z-axis) 380 perpendicular to the x-axis 340 and the y-axis 360. Alternatively, the depth (z-axis) 380 of the third layer may vary along both the x-axis 340 and the y-axis 360 segmentally and/or continuously.

Figure 6:
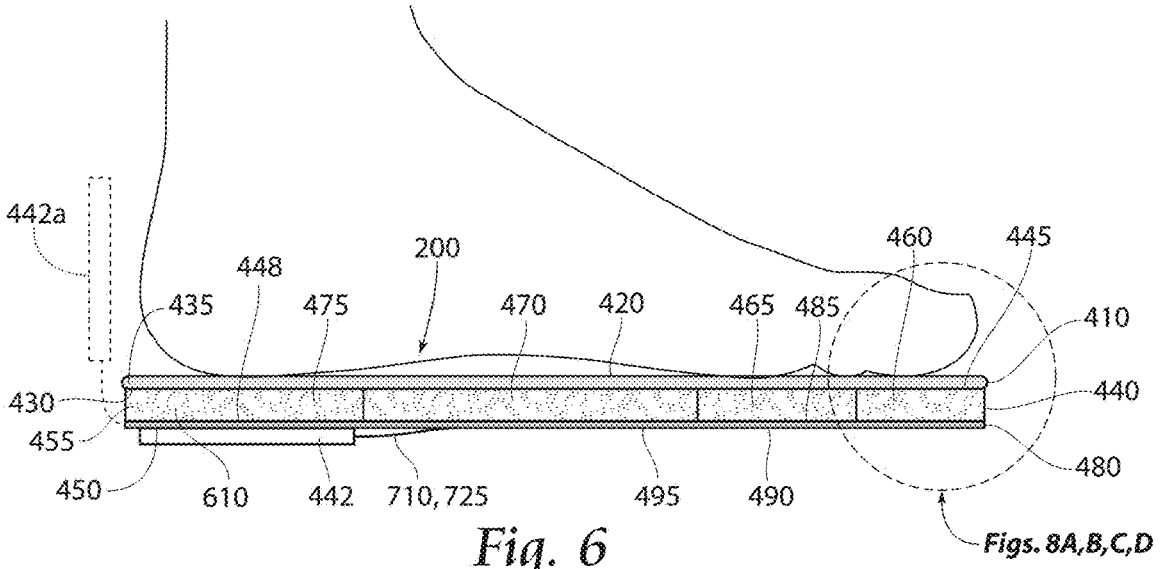
FIG. 6 is a side view of the shape shifting orthotic sole illustrating the first layer, the second layer, the third layer, and a power source and circuitry unit, and illustrating and alternate position of the power source and circuitry unit

FIG. 6 illustrates, the reverse side 490 of the third layer 480 is preferably chemically or mechanically adhered to a top side 448 of a power source and circuitry unit 442. In addition, the power source and circuitry unit 442 is electrically connected to the third layer 480. An electrical connection (710, 725) between the power and circuitry unit 442 and the third layer 480 is preferably a solid wiring connected between the layers or direct contact between the layers. Alternatively, the electrical connection between the power source and circuitry unit 442 the said third layer 480 may be through the use of a USB-A, USB-B, USB-mini, or USB-micro cable system. The electrical connection location on the third layer 480 is preferably on the reverse side 490 of the third layer 480. Alternatively, the connection point of the third layer 480 may be located on the lateral side 495 of the third layer 480.

The power source and circuitry unit 442 may preferably be located towards a posterior or heel direction 610 of the shape shifting orthotic sole 200. The power source and circuitry unit 442 may be a uniform depth (z-axis) 380 perpendicular to the x-axis 340 and y-axis 360. Alternatively, the depth (z-axis) 380 of the power source and circuitry unit 442 may vary along both the x-axis 340 and y-axis 360 segmentally and/or continuously. Alternatively, the power source and circuitry unit 442 may be communicated to the back 110 of the shoe (442*a*, 100). The power source and circuitry unit 442 preferably rests on the foot placement surface 240 of the shoe 100. Alternatively, the power source and circuitry unit 442 is recessed into a sole portion 130 of the shoe 100. The power source and circuitry unit 442 may rest at a depth along a spectrum 140 of the sole portion 130 of the shoe 100. The power source and circuitry unit 442 may alternatively be adhered chemically or mechanically to the back 110 of the shoe 100.

As illustrated in FIGS. 8A-8D, the regions (460, 465, 470, and 475) of the second layer 440 preferably have three support settings. A user exerts force 805 on the shape shifting orthotic sole 200. The shape shifting orthotic sole may preferably respond with one or a combination of the following support settings:

Rigid: Used to reduce pronation, increase stability when forces are significant 820.

Semi-Rigid: Used to provide balance during motion when forces are moderate 815.

Soft: Used to absorb shocks and improve balance, reduce pressure when forces are minor 810.

Alternatively, the regions (460, 465, 470, and 475) can have a support setting spectrum which is continuous and not segmented.

Figure 7:
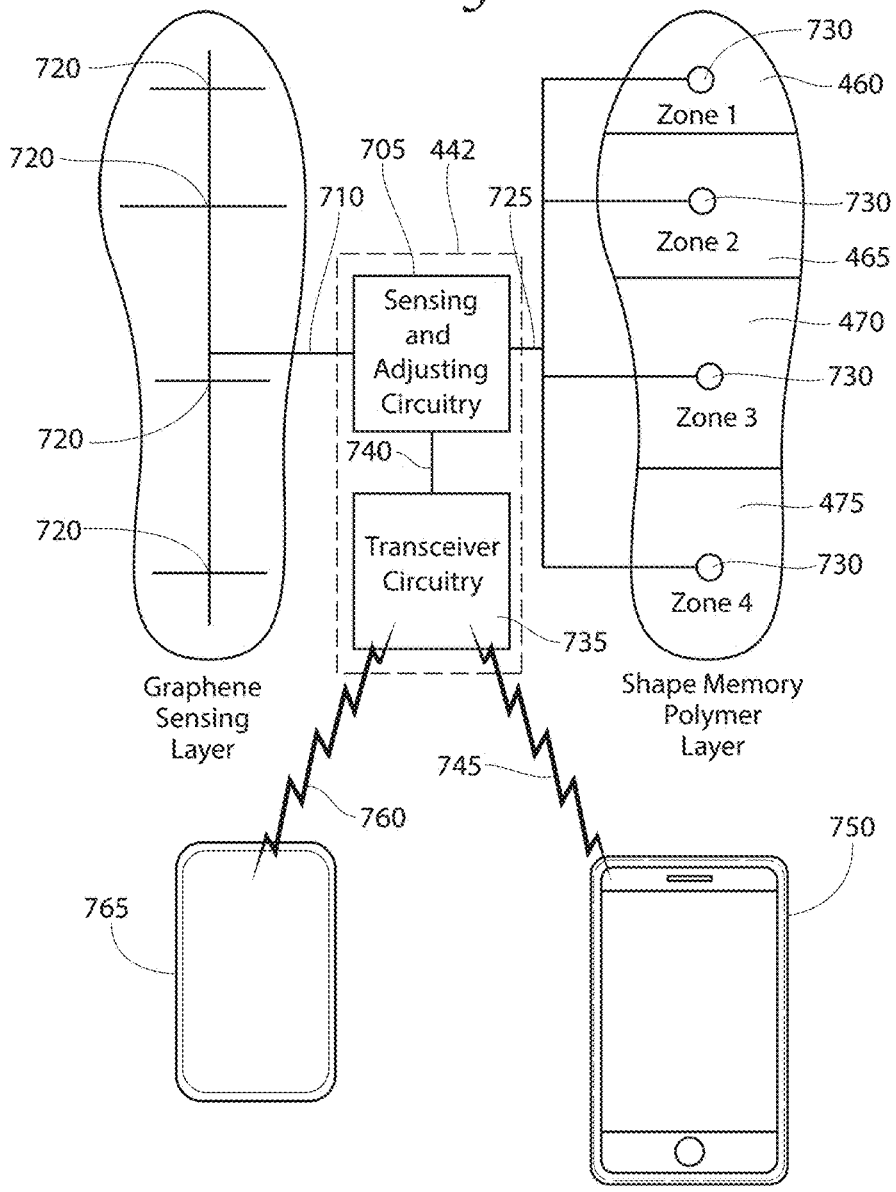
FIG. 7 is a diagrammatic illustration of the communication between the third layer, the second layer, the power source and circuitry unit, and a cellar device or any deice capable of running a mobile application.
Figure 8A:
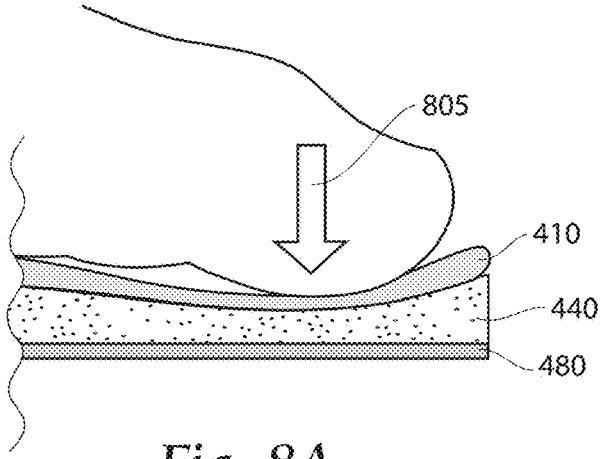
FIG. 8A is a side view of the anterior end of the shape shifting orthotic sole, as shown from FIG. 6, illustrating the user pressing the foot on the first layer of the shape shifting orthotic sole.
Figure 8B:
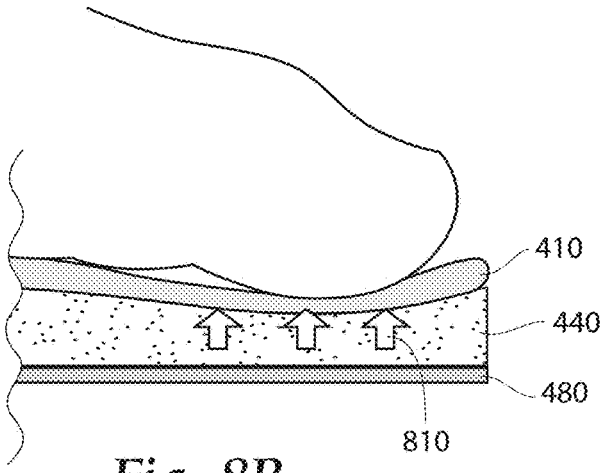
FIG. 8B is a cross sectional view of the anterior end of the shape shifting orthotic sole, as shown from FIG. 6, illustrating the shape shifting orthotic sole exerting a soft setting force.
Figure 8C:
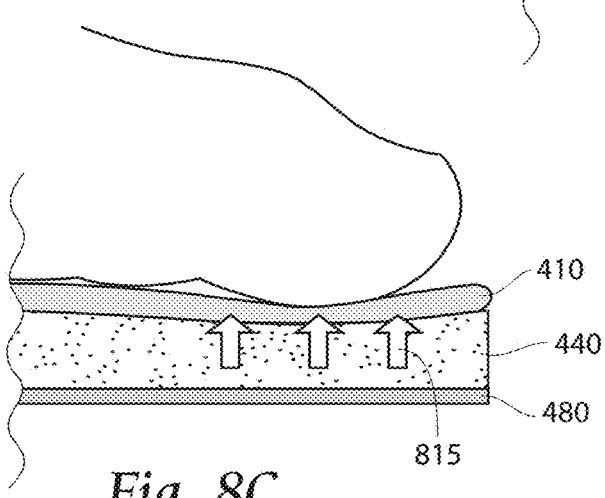
FIG. 8C is a side view of the anterior end of the shape shifting orthotic sole, as shown from FIG. 6, illustrating the shape shifting orthotic sole exerting a semi-rigid setting force.
Figure 8D:
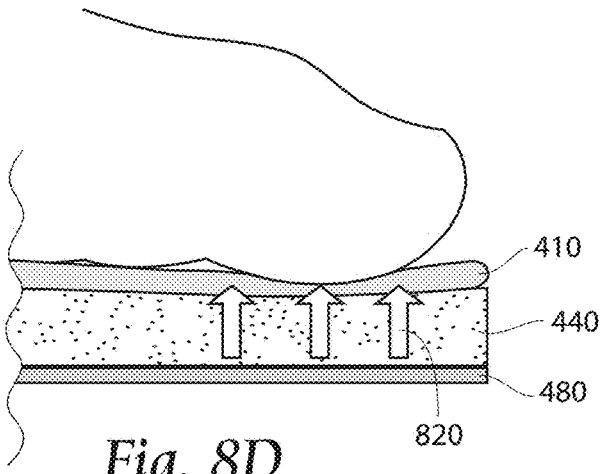
FIG. 8D is a cross sectional view of the anterior end of the shape shifting orthotic sole, as shown from FIG. 6, illustrating the shape shifting orthotic sole exerting a rigid setting force.

As referenced in FIG. 7, the, graphene, third layer 480 may be electrically connected to a sensing and adjustment circuitry 705 within the power source and circuitry unit 442. One of the most useful properties of graphene is that it is a zero-overlap semimetal (with both holes and electrons as charge carriers) with very high electrical conductivity. The electrical connection may be sourced from an amalgamation of connecting wires 710 which are sourced from various regions of the graphene sensing layer (720). Alternatively, the electrical connection may be segmented by region of the third layer 480. The sensing and adjustment circuitry 705 within the power source and circuitry unit 442 may be electrically connected to the regions (460, 465, 470, and 475) within the second layer 440. A connection to the sensing and adjustment circuitry 705 within the power source and circuitry unit 442 may be an amalgamation 725 of connecting wires sourced from the second layer. Alternatively, the electrical connection between the sensing and adjustment circuitry 705 within the power source and circuitry unit 442 and the second layer 440 maybe made by individual connections. A terminal end 730 of electronic connections to the second layer 440 maybe be a singular point, divided into a series of conduits with terminal ends, or a metallic mass of varying orientations (circular disc, circular ring, polygon disc, polygon frame, etc.).

The sensing and adjustment circuitry 705 within the power source and circuitry unit 442 is additionally electrically connected 740 to a transceiver circuitry 735 within the power source and circuitry unit 442. The transceiver circuitry 735 communicates 745 with a cellar device or other device having the ability to house and maintain mobile applications 750. Alternatively, an IOT Health Monitoring Device 765 maybe incorporated. The IOT Health Monitoring Device 765 communicates 760 vital statistics of the user to the transceiver circuitry 735. The transceiver circuitry 735 communicates 745 to the cellar device, or other device having the ability to house and maintain mobile applications 750, data which includes user vital statistics communicated 760 to the transceiver circuitry 735 from the IOT Health Monitoring Device 765.

Figure 14A:
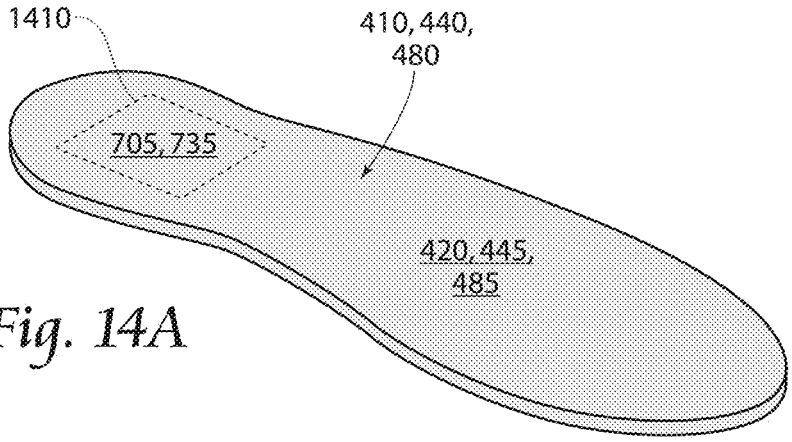
FIG. 14A is a perspective view of at least one of the first layer, the second layer and the third layer of the shape shifting orthotic insert illustrating at least one of a sensing and adjusting circuitry and a transceiver circuitry in communication with a top side of the at least one of the first layer, the second layer and the third layer of the shape shifting orthotic insert at a first location.
Figure 14B:
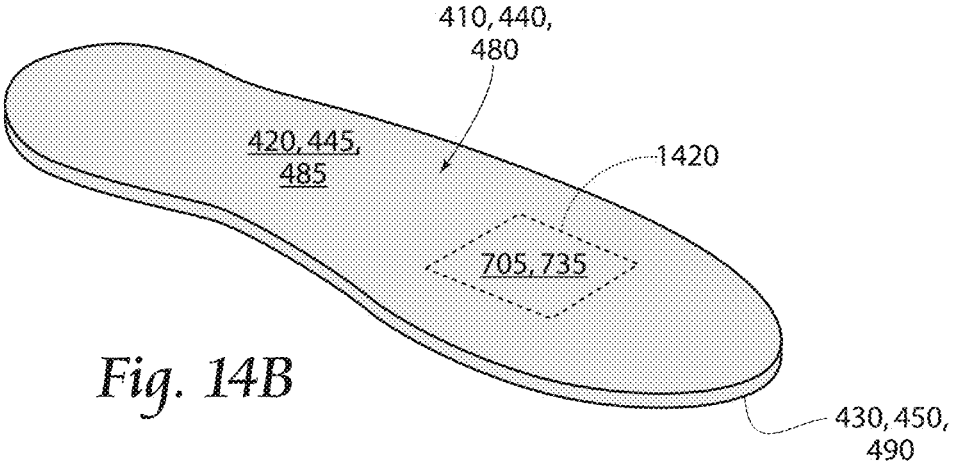
FIG. 14B is a perspective view of at least one of the first layer, the second layer and the third layer of the shape shifting orthotic insert illustrating at least one of the sensing and adjusting circuitry and the transceiver circuitry in communication with a reverse side of the at least one of the first layer, the second layer and the third layer of the shape shifting orthotic insert at a second location.
Figure 14C:
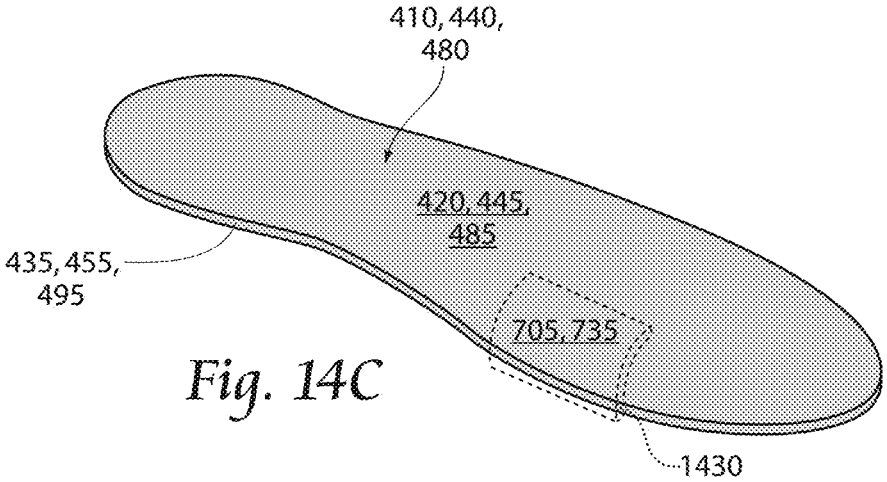
FIG. 14C is a perspective view of at least one of the first layer, the second layer and the third layer of the shape shifting orthotic insert illustrating at least one of the sensing and adjusting circuitry and the transceiver circuitry in communication with a lateral side of the at least one of the first layer, the second layer and the third layer of the shape shifting orthotic insert at a third location.

In an alternative embodiment, the sensing and adjustment circuitry 705 and the transceiver circuitry 735 may be located at different locations of the shoe 100, where only one or none is located in the power source and circuitry unit 442. In such an embodiment, the sensing and adjustment circuitry 705 is additionally electrically connected 740 to the transceiver circuitry 735, analogous to the electrical connection 740 illustrated in FIG. 7. In such an embodiment, at least one of the sensing and adjustment circuitry 705 and the transceiver circuitry 735 may be in mechanical or in chemical communication with at least one of the first layer 410, the second layer 440, the third layer 480, or the shoe 100. At least one of the sensing and adjustment circuitry 705 and transceiver circuitry 735 may be in communication with at least one of the top side 420 of the first layer 410, reverse side 430 of the first layer 420, and a lateral side 435 of the first layer 410. At least one of the sensing and adjustment circuitry 705 and the transceiver circuitry 735 may be in communication with at least one of the top side 420 of the first layer 410, reverse side 430 of the first layer 410, and the lateral side 435 of the first layer 410, at the at least one of an indefinite number of locations on the at least one the top side 420 of the first layer 410, reverse side 430 of the first layer 410, and the lateral side 435 of the first layer 410. FIG. 14A illustrates at least one of the sensing and adjusting circuitry 705 and the transceiver circuitry 735 in communication with the top side 420 of the first layer 410 at a first location 1410. FIG. 14B illustrates at least one of the sensing and adjusting circuitry 705 and the transceiver circuitry 735 in communication with the reverse side 430 of the first layer 410 at a second location 1420. FIG. 14C illustrates at least one of the sensing and adjusting circuitry 705 and the transceiver circuitry 735 in communication with the lateral side 435 of the first layer 410 at a third location 1430.

At least one of the sensing and adjustment circuitry 705 and transceiver circuitry 735 may be in communication with at least one of the top side 445 of the second layer 440, the reverse side 450 of the second layer 440, and the lateral side 455 of the second layer 440. At least one of the sensing and adjustment circuitry 705 and the transceiver circuitry 735 may be in communication with at least one of the top side 445 of the second layer 440, reverse side 450 of the second layer 440, and the lateral side 455 of the second layer 440, at the at least one of an indefinite number of locations on the at least one the top side 445 of the second layer 440, reverse side 450 of the second layer 440, and the lateral side 455 of the second layer 440. FIG. 14A illustrates at least one of the sensing and adjusting circuitry 705 and the transceiver circuitry 735 in communication with the top side 445 of the second layer 440 at a first location 1410. FIG. 14B illustrates at least one of the sensing and adjusting circuitry 705 and the transceiver circuitry 735 in communication with the reverse side 450 of the second layer 440 at a second location 1420. FIG. 14C illustrates at least one of the sensing and adjusting circuitry 705 and the transceiver circuitry 735 in communication with the lateral side 455 of the second layer 440 at a third location 1430.

At least one of the sensing and adjustment circuitry 705 and the transceiver circuitry 735 may be in communication with at least one of the top side 485 of the third layer 480, reverse side 490 of the third layer 480, or a lateral side 495 of the third layer 480. At least one of the sensing and adjustment circuitry 705 and transceiver circuitry 735 may be in communication with at least one of the top side 485 of the third layer 480, reverse side 490 of the third layer 480, and the lateral side 495 of the third layer 480, at the at least one of an indefinite number of locations on the at least one the top side 485 of the third layer 480, reverse side 490 of the third layer 480, and the lateral side 495 of the third layer 480. FIG. 14A illustrates at least one of the sensing and adjusting circuitry 705 and the transceiver circuitry 735 in communication with the top side 485 of the third layer 480 at a first location 1410. FIG. 14B illustrates at least one of the sensing and adjusting circuitry 705 and the transceiver circuitry 735 in communication with the reverse side 490 of the third layer 480 at a second location 1420. FIG. 14C illustrates at least one of the sensing and adjusting circuitry 705 and the transceiver circuitry 735 in communication with the lateral side 495 of the third layer 480 at a third location 1430.

At least one of the sensing and adjustment circuitry 705 and the transceiver circuitry 735 may be in communication with the back 110 of the shoe 100. Alternatively, at least one of the sensing and adjustment circuitry 705 and transceiver circuitry 735 may rest on the foot placement surface 240 of the shoe 100. Alternatively, at least one of the sensing and adjustment circuitry 705 and the transceiver circuitry 735 may be recessed into a sole portion 130 of the shoe 100. At least one of the sensing and adjustment circuitry 705 and transceiver circuitry 735 may rest at a depth along a spectrum of the sole portion 130 of the shoe 100. At least one of the sensing and adjustment circuitry 705 and the transceiver circuitry 735 may alternatively be adhered chemically or mechanically to the back 110 of the shoe 100. Positioning of at least one of the sensing and adjustment circuitry 705 and the transceiver circuitry 735 on the shoe 100 is analogous to positioning of the power source and circuitry unit (442, 442*a*) on the shoe 100, as illustrated in FIG. 6 and FIG. 10B.

Figure 11:
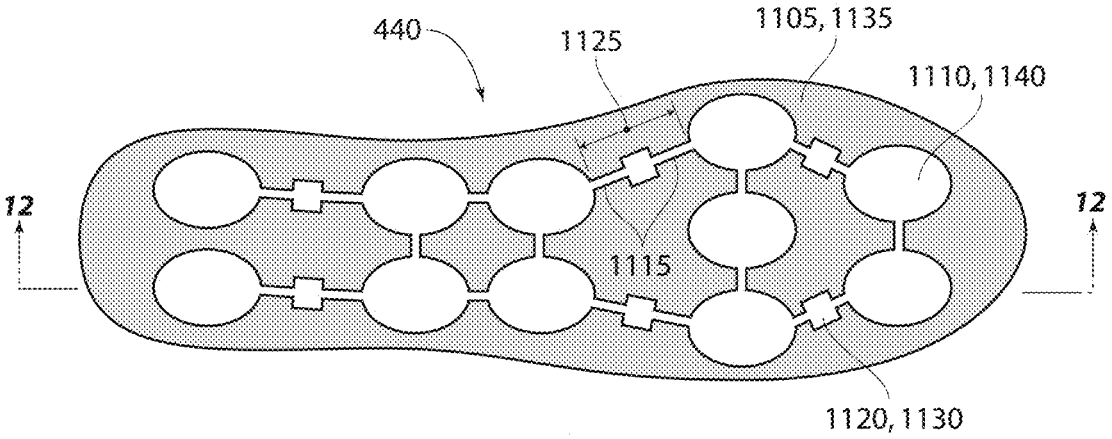
FIG. 11 is a top side view of the second layer containing a pneumatic or hydraulic system.

FIG. 11 illustrates, in an alternative embodiment, the second layer 440 incorporates a shape memory pneumatic layer. The shape memory pneumatic layer may be composed of the shape memory foam. Encased within the shape memory foam may be a closed pneumatic system 1105. The closed pneumatic system 1105 may contain regions for air accumulation 1110 connected to one another by a series of passage ways 1115. The number and orientation of the regions of air accumulation 1110 may vary dependent on the application of the shoe 100 and dimensional restrictions of the shoe 100. The system of passage ways 1115 may contain individual passage ways 1115 which vary in length 1125 dependent on the distance between regions of air accumulation 1110. The number of passage ways 1115 between any two regions of air accumulation 1110 may vary in number. Situated along the system of passages 1115 may be pneumatic valve devices 1120. The pneumatic valve devices 1120 may be preferably located between regions for air accumulation 1110. The pneumatic valve devices 1125 may bi-sect the air passageway 1115 or at any location along the air passageway 1115. Alternatively, the pneumatic valve devices 1120 may be situated within a region for air accumulation 1110. Additionally, multiple pneumatic valve devices 1120 may be located in any or all regions for air accumulation 1110. The closed pneumatic system 1105 may contain a singular or a plurality of regions of air accumulation 1110, passage ways 1115, and/or pneumatic valve devices 1120.

Figure 12:
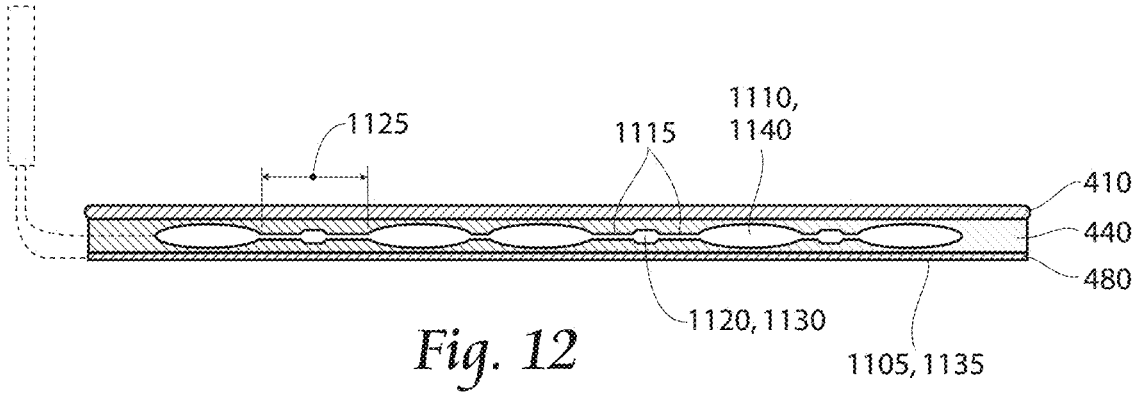
FIG. 12 is a side cross sectional view of the shape shifting orthotic sole, as shown from FIG. 11, containing a pneumatic or hydraulic system.

As provided in FIG. 12, the regions for air accumulation 1110 and the system of passage ways 1115 preferably are encased within the second layer 440. Alternatively, the regions of air accumulation 1110 and/or the system of passage ways 1115 may penetrate the top side 445 or reverse side 450 of the second layer 440, and/or penetrate the lateral side 455 of the second layer 440. Alternatively the closed pneumatic system may be a closed hydraulic system 1135. The closed hydraulic system 1135 may contain a water based fluid. Alternatively, the closed hydraulic system 1135 may contain a fluid which resists freezing. In this embodiment the pneumatic valve devices 1120 may be substituted for hydraulic valve devices 1130. In this embodiment the regions of air accumulation 1110 may be replaced by regions of hydraulic accumulation 1140. The closed hydraulic system 1135 may contain a singular or a plurality of regions of hydraulic accumulation 1140, passage ways 1115, and/or hydraulic valve devices 1130. The pneumatic valve devices 1120 of the closed pneumatic system 1105 and the hydraulic valve devices 1130 of the closed hydraulic system 1135 may operate to transfer fluids (air of hydraulic) to the appropriate regions of air accumulation 1110 or regions of hydraulic accumulation 1140 in order to attain desired pressure settings in the shape shifting orthotic sole 200.

Figure 10A:
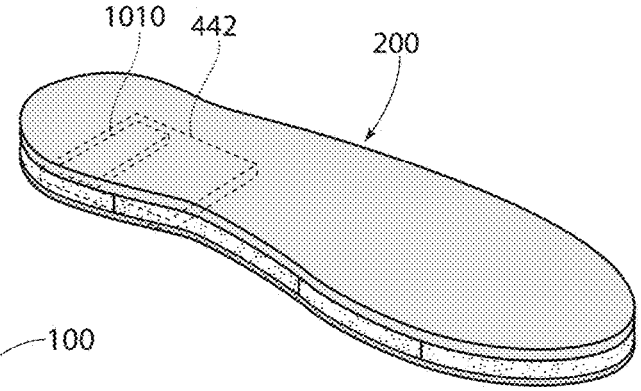
FIG. 10A is a perspective view of the shape shifting orthotic sole containing a piezoelectric recharging power source within the power source and circuitry unit.
Figure 10B:
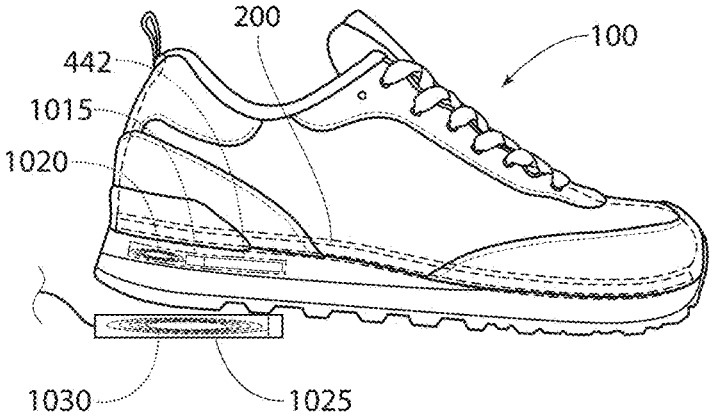
FIG. 10B is a side view of the shoe containing an inductive coil power source charging system resting on the mating induction coil charging unit.

As viewed in FIG. 10, a power source (1010, 1015) within the power source and circuitry unit 442 may be recharged with a piezoelectric system 1010. Where the motion of the user recharges the power source 1010. Alternatively, the power source 1015 within the power source and circuitry unit 442 may be recharged with an inductive coil system (1015, 1025). The inductive coil system (1015, 1025) contains inductive coils (102, 1030) in the shoe 100 power source and circuitry unit 442, and in an external power recharging source 1025. Contact between the shoe 100 containing the powers source 1020 and the external power recharging source 1025 results in a transfer of energy to the power source 1020 within the shoe 100. Alternatively, the power source may be recharged with a magnetic field based system.

Figure 13:
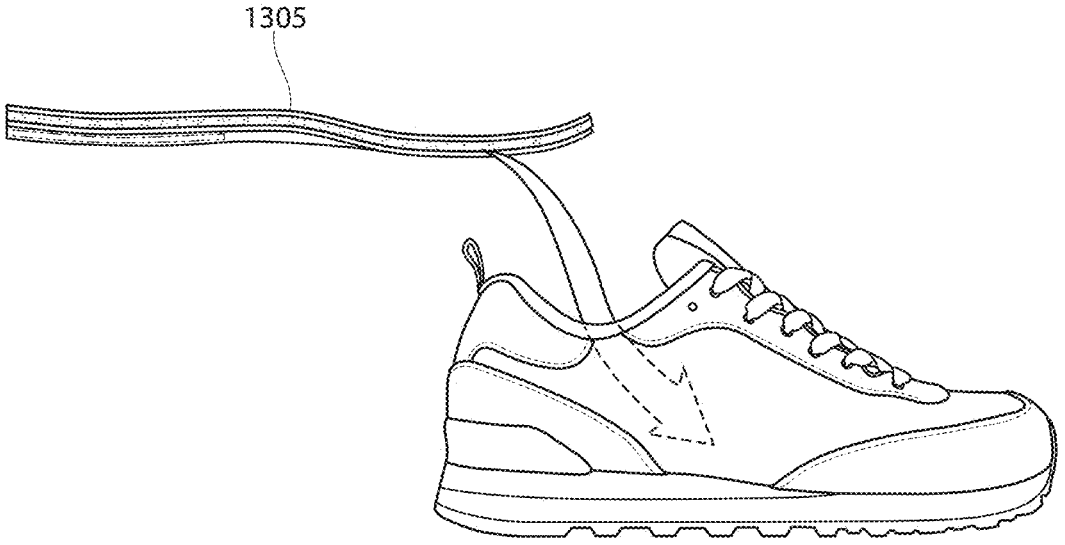
FIG. 13 is a side view of the shoe and a side view of the shape shifting orthotic insert illustrating the insertion of insertion of the shape shifting orthotic insert into the shoe.

As illustrated in FIG. 13, in an alternative embodiment, the shape shifting orthotic may be incorporated in a shoe insert 1305. The shape shifting layers of the shoe insert are composed and comprised similar to that of the shape shifting orthotic sole 200.

Figure 9A:
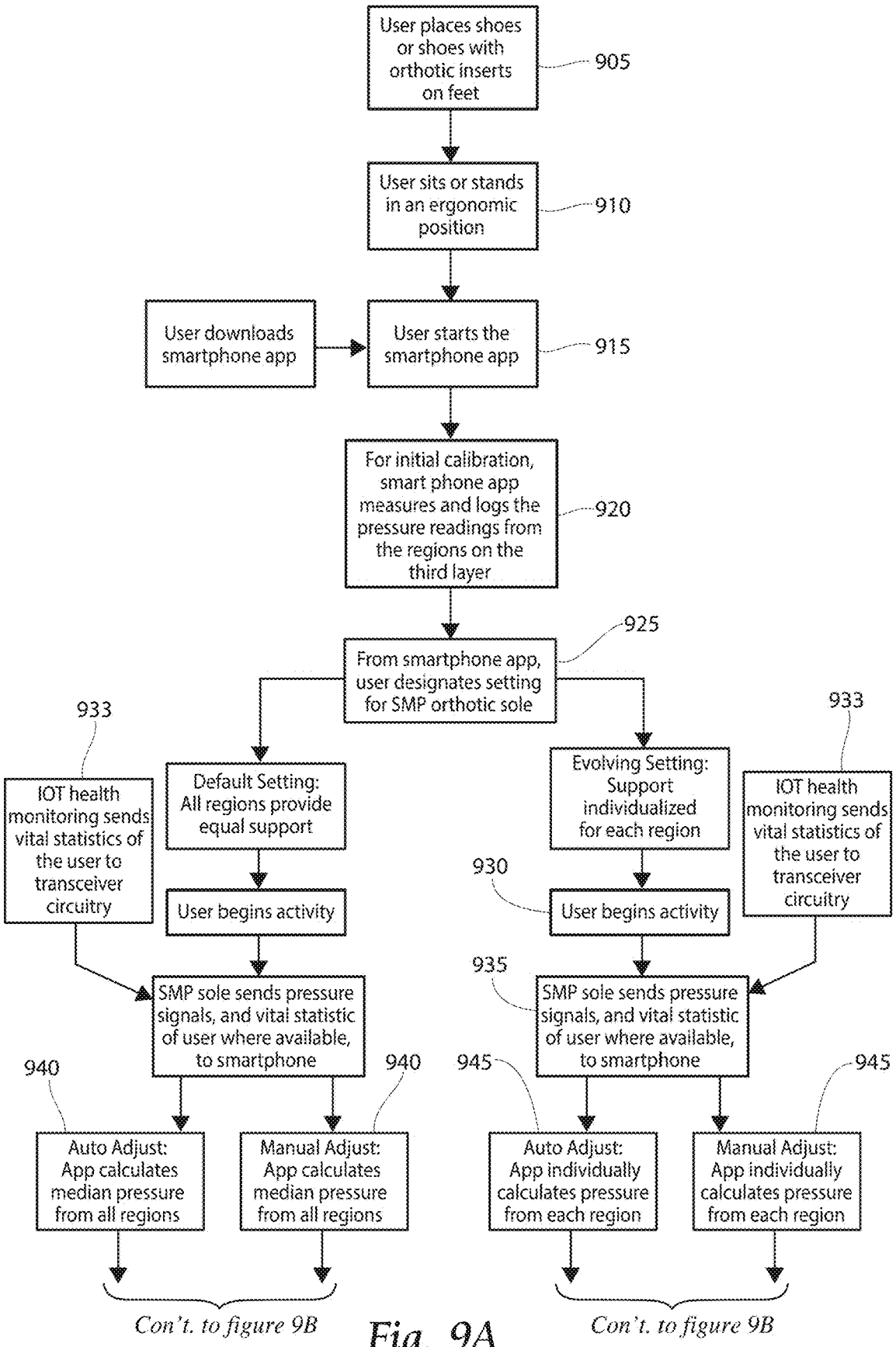
FIG. 9A and FIG. 9B is a flow diagram of the method of operating the shape shifting orthotic sole.
Figure 9B:
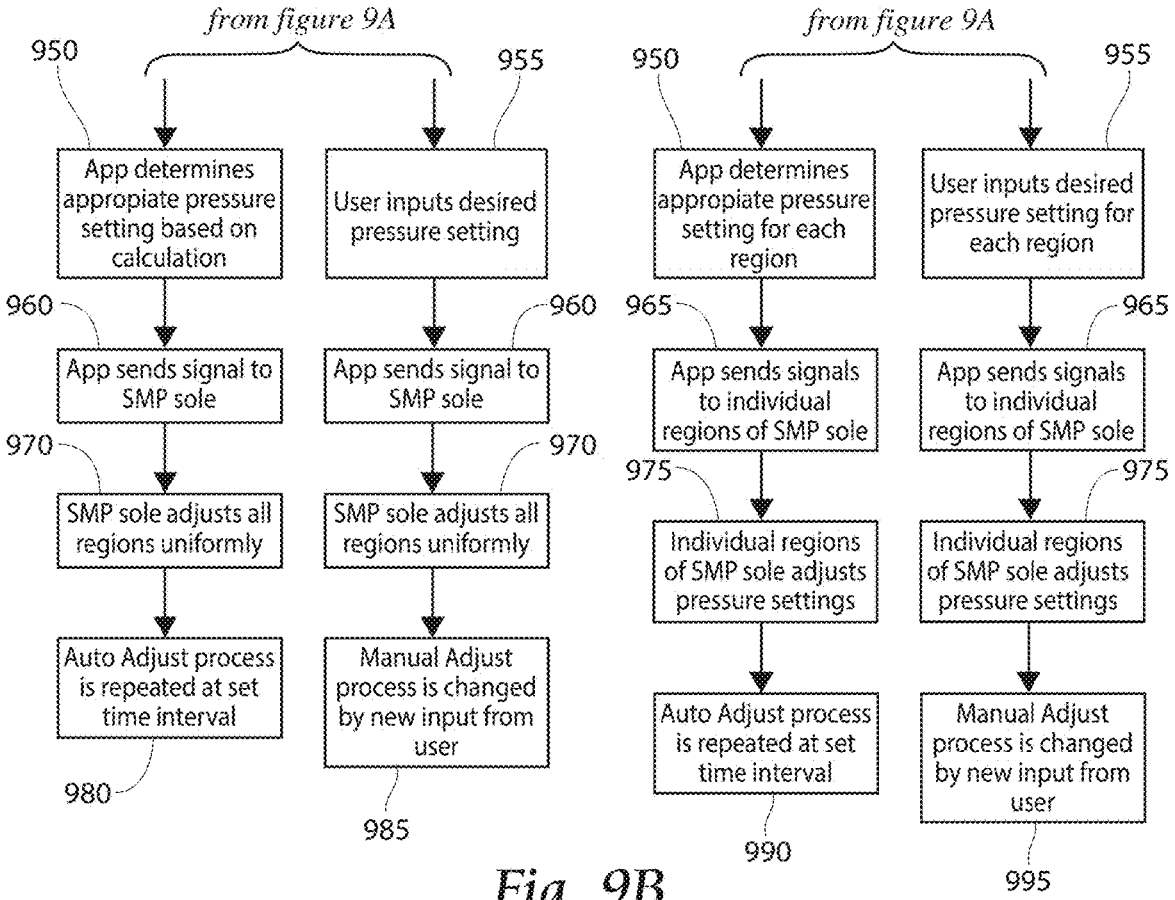

FIGS. 9A and 9B illustrate a method of use of the shape shifting orthotic sole 200 and the shape shifting orthotic sole insert 1305. A method of use is further provided wherein a user places a foot down on the top side 420 of the first layer (410, 905). The user may stand in an ergonomic position 910. The user may upload a mobile application and starts using the mobile application using a cellar device or other device having the ability to house and maintain mobile applications (750, 915). The user may calibrate settings for the shape shifting orthotic sole (200, 920). The mobile application may transmit 745 a request, via the cellar device or other device having the ability to house and maintain mobile applications 750, for the calibration to the power source and circuitry unit 442. The power source and circuitry unit 442 may commence the calibration. The calibration may measure and may log the pressure readings from the regions on the third layer 480. The third layer 480 may transmit information, via the sensing and adjusting circuitry 705, to the transceiver circuitry 735. The transceiver circuitry 735 may transmit 745 information to a cellular device or other device having the ability to house and maintain mobile applications 750. The mobile application may record baseline and differential pressures during walking or running. The mobile application may record vital statistics from an IOT Health Monitoring Device 765.

The user may proceed to designate the settings for the shape shifting memory sole 200 or shape shifting memory sole insert 1305. The user may choose between default settings, all regions (460, 465, 470, and 475) in the second layer 440 are provided equivalent support, and evolving settings, each region (460, 465, 470, and 475) in the second layer 440 is provided individualized settings 925. The user may begin an activity, whether it be sitting, standing, walking, running, jumping, etc. 930.

Layer three 480 of the shape shifting memory sole 200 or shape shifting memory sole insert 1305 may transmit pressure signals to the sensing and adjustment circuitry 705, which communicate may 745 to the cellular device or other device having the ability to house and maintain mobile applications 750 via transceiver circuitry (735, 935). Alternatively, an IOT Health Monitoring Device 765 communicates (760, 933) vital statistics of the user to the transceiver circuitry (735, 935). The transceiver circuitry (735, 935) communicates 745 the pressure signals and user vital statistics to the cellular device or other device having the ability to house and maintain mobile applications 750.

The mobile application may perform calculations based on the user's earlier input. Alternatively, the mobile application incorporates the user vital statistics into the calculations with the user's earlier inputs. Where the user requested default settings, the mobile application may calculate median pressure for all regions (460, 465, 470, 475, 940). Where the user requested evolving settings, the mobile application may calculate pressure for each region 945.

The user may initially designate whether the system will automatically adjust pressure settings or whether the user will manually adjust pressure settings. Where the user chooses to have the system automatically adjust pressure settings, the mobile application may determine appropriate pressure settings for default and evolving settings 950. Where the user chooses to manually adjust pressure settings, the user may input the desired pressure settings 955.

The mobile application may send a signal 745 via the cellular device or other device having the ability to house and maintain mobile applications 750 to the transceiver circuitry 735 which may be in communication with the sensing and adjusting circuitry 705. The signal may be transferred to the second layer 440. In the case of default settings, a uniform signal may be transferred to each region (460, 465, 470, and 475) of the second layer (440, 960). The regions (460, 465, 470, and 475) of the second layer 440 may adjust in uniform 970. In the case of evolving settings, individualized signals may be sent to individual regions (460, 465, 470, and 475) of the second layer 440. The individual regions (460, 465, 470, and 475) of the second layer 440 may adjust according to the pressure settings received 975.

Where the user has chosen the automatic adjustment, the measuring and adjustment process may continue automatically at a set time interval (980, 990). Where the user has chosen the manual adjustment feature, the measuring process may continue at a set time interval (985, 995). However, pressure settings may not be adjusted unless the user provides new input (985, 995).

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A shape shifting orthotic sole for footwear to be worn by a user, comprising:

an at least one shape changing layer having a first side and a reverse side;

the at least one shape changing layer having at least two shape changing polymer regions;

the at least two shape changing polymer regions providing at least two support settings defining a rigidity for each of the at least two shape changing polymer regions;

the reverse side of the at least one shape changing layer in communication with a first side of an at least one sensing layer;

the at least one shape changing layer and the at least one sensing layer comprising separate layers of the shape shifting orthotic sole;

the at least one sensing layer having an at least one region, where the at least one region is a sensing region;

a power source communicatively coupled with a processor;

the processor communicatively coupled with the at least one region of the at least one sensing layer, wherein the processor receives an at least one pressure measurement from the at least one region of the at least one sensing layer at a predetermined time interval;

the processor communicatively coupled with each of the at least two shape changing polymer regions of the at least one shape changing layer, the processor including an automatic adjustment of at least two support setting for the at least two shape changing polymer regions, provided through calculations employing at least one pressure measurement from the at least one region of the at least one sensing layer, wherein the processor communicates the at least two support settings to the at least one shape changing layer; and the processor having a default mode and an evolving mode from which the user selects, the default mode providing for adjustments to the at least two support settings for the at least two shape changing polymer regions so that all support settings are uniform as to the rigidity, the rigidity in the default mode being a median of the at least two support settings where each of the at least two support settings is calculated for a respective shape changing polymer region, and the evolving mode providing for adjustments to the rigidity for each of the at least two shape changing polymer regions independent of one another.

2. The shape shifting orthotic sole for footwear of claim 1 further comprising a cushioning layer providing for a first side for placement of a foot and reverse side, with the reverse side of the cushioning layer in communication with the first side of the at least one shape changing layer, with the cushioning layer comprising a shell and a core, with the processor in communication with to the cushioning layer.

3. The shape shifting orthotic sole for footwear of claim 1 further comprising the shape shifting orthotic sole at least one of fixed to an interior floor of a shoe, defined by a back, a front, an exterior sole and the interior floor, and removable from the interior floor of the shoe, wherein a user places a foot into the shoe and rests the foot on the shape shifting orthotic sole.

4. The shape shifting orthotic sole for footwear of claim 3 further comprising a shape of the shape shifting orthotic sole received by at least one of the interior floor, a lateral wall, an anterior wall and a posterior wall of the shoe, with the shape providing for mechanical adjustment.

5. The shape shifting orthotic sole for footwear of claim 3 further comprising the processor in communication with at least one predetermined location on the shoe.

6. The shape shifting orthotic sole for footwear of claim 1 further comprising the sensing layer is a graphene sensing layer.

7. The shape shifting orthotic sole for footwear of claim 1 further comprising the processor communicatively coupled with the at least one sensing layer through at least one of a solid wiring and a USB system.

8. The shape shifting orthotic sole for footwear of claim 1 further comprising the at least two shape changing polymer regions of the at least one shape changing layer having three support settings; rigid, semi-rigid, soft.

9. The shape shifting orthotic sole for footwear of claim 1 further comprising the at least one shape changing layer providing for at least one of a shape memory pneumatic layer containing a closed pneumatic system, and the shape memory pneumatic layer containing a closed hydraulic system.

10. The shape shifting orthotic sole for footwear of claim 1 further comprising the processor electrically coupled with the at least two shape changing polymer regions of the at least one shape changing layer, the processor including a manual adjustment for the at least two support settings, wherein the processor communicates the at least two support settings to the at least two shape changing polymer regions through a manual input of the at least two support settings.

11. The shape shifting orthotic sole for footwear of claim 1 further comprising the shape shifting orthotic sole including for a calibration.

12. The shape shifting orthotic sole for footwear of claim 1 further comprising the processor including a sensing and adjustment circuitry and a transceiver circuitry, with the sensing and adjustment circuitry communicatively coupled with the transceiver circuitry.

13. The shape shifting orthotic sole for footwear of claim 1 further comprising the sensing and adjustment circuitry communicatively coupled with the at least one region of the at least one sensing layer, the sensing and adjustment circuitry communicatively coupled with the at least two shape changing polymer regions of the at least one shape changing layer with the sensing and adjustment circuitry including at least one of the automatic adjustment and the manual adjustment, the sensing and adjustment circuitry including at least one of the default mode and the evolving mode, wherein the sensing and adjustment circuitry receives the at least one pressure measurement from the at least one region of the at least one sensing layer at the predetermined time interval and the sensing and adjustment circuitry communicates the rigidity for each of the at least two shape changing polymer regions.

14. The shape shifting orthotic sole for footwear of claim 12 further comprising the sensing and adjustment circuitry communicatively coupled with the transceiver circuitry, the sensing and adjustment circuitry including at least one first reception from the transceiver circuitry, an at least one first transmission to the transceiver, and an at least one second reception from the transceiver, wherein the at least one first reception is a calibration request, the at least one first transmission is the at least one pressure measurement, and the at least one second reception is the at least two support settings.

15. The shape shifting orthotic sole for footwear of claim 14 further comprising the transceiver communicatively coupled with at least one of a cellular device and another device able to maintain mobile applications, the at least one of the cellular device and the other device able to maintain mobile applications including at least one second transmission to the transceiver, an at least one third reception from the transceiver, and at least one third transmission to the transceiver, wherein the at least one second transmission is a calibration request, the at least one third reception is a receipt of the at least one pressure measurement, and the at least one third transmission is a transmission of the at least two support settings.

16. The shape shifting orthotic sole for footwear of claim 15 further comprising an IOT Health Monitoring Device communicatively coupled with the transceiver, the transceiver including an at least one fourth reception from the IOT Health Monitoring Device and an at least one fourth transmission to the at least one of the cellular device and the other device able to maintain mobile applications, wherein the at least one fourth reception and the at least one fourth transmission concern transmitting of data from the IOT Health Monitoring Device for use in calculating of the at least two support settings.

* * * * *